US008403724B1

(12) United States Patent
Chapin

(10) Patent No.: US 8,403,724 B1
(45) Date of Patent: Mar. 26, 2013

(54) PAJAMAS INCORPORATING A BRASSIERE

(76) Inventor: Claire Chapin, Westborough, MA (US)

( * ) Notice: Subject to any disclaimer, the term of this patent is extended or adjusted under 35 U.S.C. 154(b) by 270 days.

(21) Appl. No.: 12/795,535

(22) Filed: Jun. 7, 2010

Related U.S. Application Data

(60) Provisional application No. 61/185,050, filed on Jun. 8, 2009.

(51) Int. Cl.
*A41C 3/00* (2006.01)

(52) U.S. Cl. ..... 450/32; 450/28; 450/30; 450/31; 2/106

(58) Field of Classification Search ..... 450/28–33, 450/7–11, 14–17, 86, 88, 54–58; 2/104–108, 2/113–115, 69, 73, 78.1–78.4, 79, 243.1
See application file for complete search history.

(56) References Cited

U.S. PATENT DOCUMENTS

| | | | | | |
|---|---|---|---|---|---|
| 1,164,642 | A * | 12/1915 | Guinzburg | ..... | 450/30 |
| 1,254,043 | A * | 1/1918 | James | ..... | 450/31 |
| 4,411,269 | A * | 10/1983 | Weintraub | ..... | 450/58 |
| 5,516,234 | A * | 5/1996 | Duchesne | ..... | 405/186 |
| 5,611,084 | A * | 3/1997 | Garry et al. | ..... | 2/93 |
| 7,186,163 | B2 * | 3/2007 | Carlucci | ..... | 450/28 |

* cited by examiner

*Primary Examiner* — Gloria Hale
(74) *Attorney, Agent, or Firm* — Chapin IP Law, LLC

(57) ABSTRACT

A garment provides a shirt having sleeve portions and a body portion. The body portion defines a body cavity. A bra is disposed within the body cavity of the shirt and is loosely coupled to the body portion of the shirt via at least one attachment point. The garment is wearable by a woman in a manner in which the bra provides breast support for the woman and the shirt covers the bra, and the attachment points are configured to allow the shirt to remain loose while being worn by the woman. The garment provides light soft cup breast support while sleeping and can be worn when awake before going to bed, or after waking up during daytime activities.

15 Claims, 1 Drawing Sheet

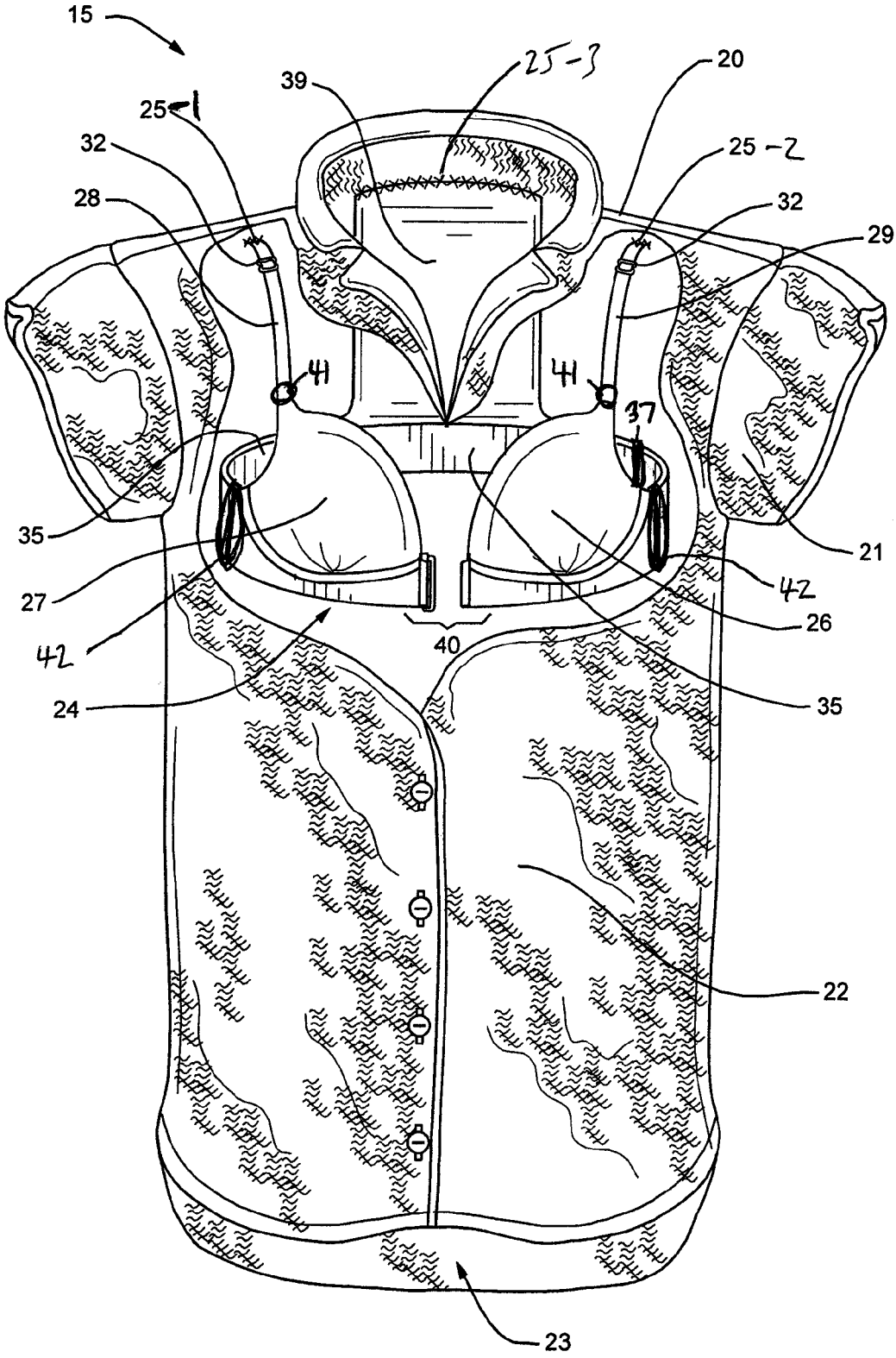
15
39
25-3
20
25-1
32
25-2
28
32
29
41
41
37
35
21
27
42
26
42
40
24
35
22
23

PAJAMAS INCORPORATING A BRASSIERE

RELATED APPLICATION

This application is related to and claims the benefit of earlier filed U.S. Provisional Patent Application Ser. No. 61/185,050 entitled "Pajamas Incorporating A Brassiere," (filed on Jun. 8, 2009, the entire teachings of which are incorporated herein by this reference.

BACKGROUND

Conventional women's pajama tops come in a variety of styles. Such styles include long sleeve pajamas that button up in the front like a button down shirt, nightgown style pajamas that pull over a person's head, short sleeve pajama tops, tank tops, negligees and the like.

A conventional woman's brassiere or bra provides support for a woman's breasts. Bras typically provide a respective breast cup to provide support for each breast, as well as elastic side straps that extend from the side of each breast cup around the back of the woman. The ends of each side strap that extend around the back of the woman typically include a coupling to allows the strap ends to attach to each other in the center of the woman's back. Additionally, a conventional woman's bra includes shoulder straps that extend from the top of each breast cup over the top and down the backside of each shoulder of the woman and couple to the top rear portion of the side straps that extend around the sides and back of the woman.

SUMMARY OF THE INVENTION

Conventional women's pajamas do not provide bra-like support for a woman's breasts. If a woman requires breast support while wearing conventional pajamas while sleeping or awake, that woman must first put on a bra and then put a pajama top over the bra. This is cumbersome since it requires putting on both garments separately.

In contrast, the present invention provides a wearable garment that combines the functionality of pajamas and a brassiere to provide a "Bra-jama" or Brajama™ garment that includes a pajama top that is loose fitting but that also incorporates a built-in bra that provides breast support. Brajama is a registered trademark of Brajamawear, LLC of Westborough, Mass., USA. In one configuration, the pajama top portion is loose fitting to allow for comfort and the bra is coupled to the pajama top portion at either the top back and/or shoulder portions of the inside of the shirt, but otherwise is allowed to "float" within the shirt to allow the bra to remain snug on the woman to provide adequate breast support while not pulling on or otherwise restricting movement within the shirt.

Other embodiments provide a garment comprising a shirt having sleeve portions and a body portion. The body portion defines a body cavity and the sleeve portions are coupled to the body portion at left and right shoulder locations. A bra is disposed within the body cavity of the shirt and is loosely coupled to the body portion of the shirt via at least one attachment point. In one configuration, the attachment point includes a back panel such as a stretchable material that is coupled to and extends along a rear neckline area of the body portion of the shirt. The back panel extends and hangs downwards from the rear neckline area (where it is coupled to the shirt) to a rear horizontal strap that is operable to extend from a left bra cup, around the back of a woman's torso, to a right bra cup. The garment is wearable by a woman in a manner in which the bra provides breast support for the woman and the shirt covers the bra, and the attachment point allows the shirt to remain loose while being worn by the woman. In one configuration the back panel has a coupling to the rear neckline area of the body portion of the shirt. The coupling is wide in one configuration and extends between left and right shoulder locations where the sleeve portions attach to the body portion of the shirt. That is, the back panel has a width that is substantially equivalent to the distance the coupling extends between left and right shoulder locations.

Another embodiment provides a shirt having a body portion that defines a body cavity. A bra is included and housed within the shirt and is operable to be worn to provide breast support to a woman's breasts. The bra includes left and right breast cups and a rear strap operable to extend around a back of a woman's torso. The bra further includes front breast cup straps that extend, respectively, from the top of each breast cup to an upper shoulder area of the shirt. The breast cup straps providing front breast support to a respective breast cup to which they attach. The bra further includes a back panel coupling the rear strap to an upper back area of the shirt. The back panel in either a wide or narrower configuration allows side to side rotational movement of the woman's torso without substantially translating the movement to the shirt. In its wide configuration the back panel also provides a mechanism to ease in putting on the garment since a woman's arms and hands do not become tangled in the garment during insertion from the bottom of the garment body but before the arms have entered the sleeves.

DETAILED DESCRIPTION

Embodiments disclosed herein provide a garment that includes a bra to provide breast support to a woman while at the same time providing a shirt that can be worn day or night while sleeping. The shirt portion of the garment may be any type of clothing worn on the torso of a woman. The bra is coupled to the inside of the shirt but in a manner that does not cause the shirt to be pulled in frontal areas of the shirt due to movement of a woman wearing the bra within the shirt. In other words, the bra provide light but snug breast support and is loosely coupled to the inside of the pajama top shirt garment in a manner that allows the pajama top to be lose enough to move around during normal waking or sleeping movements without tugging at the bra to cause discomfort.

FIG. 1 is an example of one embodiment of the garment 15 disclosed herein. The garment 15 includes a shirt 20 having sleeve portions 21 and a body portion 22. The shirt 20 may be any type of shirt such as a short-sleeve or long sleeve or ¾ sleeve length shirt, and may be an open front shirt such as that shown (e.g. a button down shirt) or a closed front shirt (e.g. t-shirt, nightshirt, sweatshirt, etc). Other examples of the shirt include long or short sleeve pajama tops, t-shirts, tank tops, nightshirts, button down shirts, zip-up shirts, robes, jackets or any other type of clothing item that may be worn on the torso of a woman. In one configuration, the shirt is a pajama top and can be worn at night while sleeping. The body portion 22 defines a body cavity 23 (i.e., the inside area of the shirt). A bra is 24 is disposed within the body cavity 23 of the shirt 20. The bra 24 is loosely coupled to the body portion 22 of the shirt via at least one attachment point 25.

In the illustrated example, there are three attachment points 25-1, 25-2 and 25-3. Attachment points 25-1 and 25-2 couple the tops of the left and right shoulder straps 28 and 29 to respective left and right upper shoulder areas on the inside of the shirt 20. Attachment point 25-3 is a coupling of a back panel 39 at or around the proximity of the inside of the shirt near or just below the neck area of the shirt collar. The back panel 39 may be wider than as illustrated as well. In particular, a top of the back panel 39 that connects (e.g. is sewn or coupled in another manner at location 25-3, such as with a detachable coupling mechanism) to the upper back area of the shirt 20 can extend along a shoulder line towards where each of the left and right sleeves are sewn onto the shirt. In this configuration, the back panel is wider that that illustrated can extend downwards to the strap 35 in this wide configuration. In one example, the back panel is approximately as wide as a person's shoulder blades are apart from each other as measured between the a left and right shoulder blade across the back of a woman. In a wider configuration, the back panel 39 is approximately as wide as the distance between the two sleeve attachment points.

Note in one configuration, the attachment points 25 for each bra strap to a shoulder region of the shirt 22 are permanent, while in another configuration, they are detachable to allow removal of the bra from within the shirt 20. As an example, attachment points 25-1 and 25-2 may be snaps or other suitable couplings that may be coupled and uncoupled any number of times. Likewise, attachment point 25-3 may be a series of snaps, or a sipper connection, or a slide in connector, Velcro, or other suitable connection mechanism to allow detachment of the back panel 39.

In this configuration, the garment 15 is wearable by a woman in a manner in which the bra 24 fits snugly to the upper torso of the woman and provides breast support (e.g. light breast support) for the woman and the shirt 20 covers the bra 24 when buttoned up. The attachment point(s) 25 and the back panel 39 allow the shirt 20 to float and to remain loose on the woman while being worn by the woman, while the bra portion (e.g. strap 35, cups 26 and 27, and straps 28 and 29) fits snugly and provides adequate breast support. That is, the design allows movement of the bra that is snugly fitting to a woman's upper body or torso to provide breast support while at the same time limiting movement or strains imposed on the shirt by the bra. This provides comfort in wearing the shirt with the added benefit of breast support.

By having the bra attached within the shirt to form the garment, but also providing and allowing movement of the shirt, the garment serves multiple purposes of providing breast support while awake and standing, walking, exercising, doing chores, etc. and while sleeping. During sleeping, the bra is comfortable and provides nighttime breast support. Further, the garment allows a person who wakes up from a nights rest to get out of bed and have immediate breast support without having to take off her nightshirt or pajamas to put on the bra. In other words, the bra, being part of the garment, provides breast support upon waking and enables the woman to begin daily activities without changing. The garment thus provides a form of loungewear that bridges the gap between wearing conventional pajamas that do not provide any breast support (or if they do they are in the form of a negligee that is to revealing to wear in most public manners) and having to change from pajamas into a bra and shirt. Instead, using the garment disclosed herein, the woman can sleep with breast support and can simply wake up, get out of bed and begins the day without worrying about breast support and without changing.

As further illustrated in FIG. 1, the bra 24 includes a left breast cup 26 and a right breast cup 27. The breast cups 26 and 27 can be made of any material typically used to form breast cups in bras and can be padded, or simply a thin layer of cloth or foam into which a woman's breast resides while being worn to enable breast support. A left shoulder strap 28 extends upwards from the left breast cup 26, and a right shoulder strap 29 extends upwards from the right breast cup 27. The left and right shoulder straps 28, 29 couple to inside body portions of the shirt at respective attachment points 25-1 and 25-2. As an example, the left and right shoulder straps 28, 29 can be sewn in place to couple to the body portion of the shirt via respective attachment points 25 located in respective left and right upper shoulder areas of the body portion of the shirt 20. The upper shoulder areas can be, for example, the area where front and back panels of the body portion 22 of the shirt meat at a seam that runs along the top of each shoulder near the neck or collar area of the short 20. As noted above, the attachments points may also include detachment mechanisms such as snaps.

In one configuration the left shoulder strap 28 and right shoulder strap 29 each include respective adjustment mechanisms 32 such as buckles, buttons, Velcro, or other mechanisms to allow adjustment in respective lengths of the left and right should straps. This allows a woman to adjust the vertical placement of the left and right breast cups 26, 27 to accommodate different body shapes and sizes.

The bra 24 includes a rear strap 35 that couples to outer edges of the left breast cup and right breast cup. The rear strap 35 may be elastic in nature to allow it to stretch and conform snugly to a woman's back when the bra 24 is worn within the short 20. That is, the rear strap 35 extends snugly around a back of the woman and inside the body cavity of the shirt when the garment is being worn. In one configuration, the rear strap 35 includes a rear adjustment mechanism 37 such as a buckle, snap couplings of the like that may be located anywhere along the length of the strap, or at the outer edges of either or both left and right breast cups 26, 27. The rear adjustment mechanism 37 may be a buckle, snaps, hook fasteners, Velcro or the like that allows adjustment in snugness around the back of the woman for the rear strap 35. As noted above, the left and right shoulder straps couple to inside body portions of the shirt via respective attachment points 25-1 and 25-2 and 25-3 (the rear panel 39) that may be detachable to allow removing of the bra from within the shirt.

To allow the bra 24 to "float" within the shirt 20 while it is being worn and to allow the shirt to move with the body of the woman without pulling the woman's breast in various directions, the bra is loosely attached to the shirt in areas that do not restrict movement of the woman. In one configuration, the garment includes a rear coupling 39 that loosely couples the rear elastic strap 35 to a back portion of body portion of the shirt. By coupling the bra to the back of the shirt, movement of front parts of the woman, such as the breasts (supported in the left and right breast cups), chest, and arms does not impose substantial movement on the breast and bra support. Additionally, by coupling the bra at the back, and via the should straps 28 and 29 at the shoulders, adequate breast support is provided by the bra, while limiting movement imposed into the shirt by any upper body movements of the woman. In other words, the bra in somewhat tethered to the shirt, but is allowed to float within the shirt (via couplings in this example at the tops of the shoulders where a normal shirt would rest on a person shoulders) to provide a comfortable and functional fit to both the shirt and the bra and movement of each does not substantially impact movement or impose strain on the other.

In one configuration, the rear coupling 39 is a cloth panel sewn to an upper area of the back portion (e.g. just below the collar line in the rear of the neck on the back of the shirt). The cloth panel rear coupling 39 may be made of a stretchable material such as spandex or the like and maintains positioning of the rear elastic strap to allow less restricted movement of the bra, being worn by a woman for breast support, within the shirt. The is in contrast to conventional pajamas such as negligees that attempt to provide breast support by tightly coupling and integrating the bra and negligee material into one tightly coupled and cohesive structure.

In one configuration, the rear coupling 39 (e.g. cloth panel) is made of elastic cloth material to further accommodate movement of the body in relation to the short. To couple to the rear strap 35, the rear coupling in one configuration forms a tube or sheath of cloth through which the rear elastic strap passes as it extends from the left breast cup 26 to the right breast cup 27. In other words, the lower part of the cloth panel is stitched onto itself to form a cloth tube through which the rear strap 35 passes. In another configuration, the rear panel 39 and strap 35 are integrally formed from stretchable material. Either design allows torsional rotation of the woman's upper body to the left and right which causes the bra to follow, but imposes less movement into the shirt 20 since the rear strap can slide left and right within the tube or sheath or simply allows the rear panel to stretch a bit to accommodate such movement. The elasticity of the cloth panel 39 further helps to isolate movement of the bra (which due to the rear elastic strap is rather snug fitting around the woman's torso and breasts) from the shirt 20.

In one configuration, such as that used in a pull-over version, the top of the panel 39 is wide enough to extend outwards towards the edge of the shoulder area (near where each sleeve is attached. For the pullover configuration, this avoids a person's arms from getting inserted behind the panel.

In one configuration, a front coupling 40 extends between and couples an inside edge of the left breast cup 26 and an inside edge of the right breast cup 27. This completes a full circle around the woman's torso at the breast line and allows the rear strap, bra cups 26 and 27 and front coupling to maintain a snug fit and maintain the breast support in relation to the woman's upper body.

In one configuration, the front coupling 40 is detachable via snaps, a buckle, hook fastener(s), buttons, velcro or other mechanism to allow separation of the coupling between the left breast cup 26 and right breast cup 27. In such a configuration, the shirt 20 is typically an open front shirt (e.g. a button-down shirt) and the body portion 22 of the shirt includes a left front side and a right front side that can be coupled to each other via at least one of buttons, snaps, Velcro, and a zipper or the like. In other configurations, the left and right shoulder straps 28 and 29 couple to the left breast cup and right breast cup via detachment mechanisms 41 such as snaps, hooks or the like. Additionally, side bra cup detachment mechanisms 42 allow the bra cups 26 and 27 to be detachable from the rear strap 35. This allows interchanging of the breast cups for different sized breast cups to accommodate different sized woman's breasts while not having to change the size of the shirt. As an example, if the garment 15 is purchased it may be sold with 3 different breast cup sizes, and depending on the purchasers breast size, the bra cups 26 and 27 can be interchanged for the proper size to best fit the woman's breast by decoupled attachments 41 and 42 and swapping in a bra cup that best fits. In this configuration then, the left breast cup and right breast cup are detachable from the left and right shoulder straps to allow interchanging of the left and right breast cups to accommodate different sized woman's breasts.

In one configuration, the left and/or right bra cups include a pocket to allow insertion of a breast prosthesis. This is suitable for use by people who have mastectomies who want to provide the appearance of the presence of breast that have been removed.

In other configurations, the bra does not need to be a soft cup bra but instead may be a bra style such as a push-up bra to provide the appearance of larger breasts. Other alternatives can include a snug-fitting sports-style bra, or an underwire-style bra.

In other configurations, the left and right shoulder straps couple to inside body portions of the shirt via respective attachment points that are detachable to allow removing of the bra from within the shirt. In other words, the bra part (caps 26, rear strap 25, back panel 39 and straps 28 and 29 can unsnap or otherwise decouple to be removed form the shirt.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A garment and bra combination, comprising:

a shirt having sleeve portions and a body portion, the body portion having a back portion and defining a body cavity of the shirt; and a bra disposed within the body cavity of the shirt, the bra including:

a left breast cup having an inside edge and an outer edge;

a left shoulder strap extending upwards from the left breast cup;

a right breast cup having an inside edge and an outer edge;

a right shoulder strap extending upwards from the right breast cup, wherein the left shoulder strap and the right shoulder strap are coupled to the body portion of the shirt at a first attachment point and a second attachment point, respectively; and a rear elastic strap coupled to the outer edges of the left and right breast cups, respectively, the rear elastic strap being configured to extend snugly around a woman's back while the bra is being worn by the woman; and a rear coupling configured to loosely couple the rear elastic strap of the bra to the back portion of the body portion of the shirt, the rear coupling being made, at least in part, of cloth, wherein the rear coupling is coupled, at one end thereof, to an upper area of the back portion of the body portion of the shirt, the upper area of the back portion being located near the woman's rear neckline while the bra is being worn by the woman, and wherein the rear coupling is configured to form, at another end thereof opposite the end coupled to the upper area of the back portion, a cloth tube through which the rear elastic strap of the bra passes as it extends snugly around the woman's back, the rear elastic strap being further configured to slide back and forth through the cloth tube to allow torsional rotation of the woman's upper body while imposing reduced movement to the shirt.

2. The garment and bra combination of claim 1 wherein the left and right shoulder straps are coupled to the body portion of the shirt at respective attachment points located in respective left and right shoulder areas of the body portion of the shirt.

3. The garment and bra combination of claim 1 wherein the left shoulder strap and right shoulder strap include respective adjustment mechanisms to allow adjustment in respective lengths of the left and right shoulder straps.

4. The garment and bra combination of claim 1 wherein the rear elastic strap includes an adjustment mechanism to allow adjustment in snugness around the back of the woman for the rear elastic strap.

5. The garment and bra combination of claim 1 wherein the bra includes:

a front coupling extending between and coupling an inside edge of the left breast cup and an inside edge of the right breast cup.

6. The garment and bra combination of claim 1 wherein the front coupling is detachable to allow separation of coupling the left breast cup and right breast cup.

7. The garment and bra combination of claim 6 wherein the shirt is an open front shirt and the body portion of the shirt includes a left front side and a right front side that can be coupled to each other via at least one of buttons, snaps, hook and loop fasteners, and a zipper.

8. The garment and bra combination of claim 1 wherein the sleeve portions are short sleeves.

9. The garment and bra combination of claim 1 wherein the sleeve portions are long sleeves.

10. The garment and bra combination of claim 1 wherein the left and right shoulder straps are detachably coupled to inside body portions of the shirt at respective attachment points to allow removal of the bra from within the shirt.

11. The garment and bra combination of claim 1 wherein the left breast cup and right breast cup are detachable from the left and right shoulder straps to allow interchanging of the left and right breast cups to accommodate different sized woman's breasts.

12. A garment and bra combination, comprising:

a shirt having sleeve portions and a body portion, the body portion having a back portion and a rear neckline area, the body portion defining a body cavity of the shirt, the sleeve portions being coupled to the body portion at left and right shoulder locations; and a bra disposed within the body cavity of the shirt, the bra including:

a left breast cup having an inside edge and an outer edge;

a left shoulder strap extending upwards from the left breast cup;

a right breast cup having an inside edge and an outer edge;

a right shoulder strap extending upwards from the right breast cup, wherein the left shoulder strap and the right shoulder strap are coupled to the body portion of the shirt at a first attachment point and a second attachment point, respectively; and a rear elastic strap coupled to the outer edges of the left and right breast cups, respectively, the rear elastic strap being configured to extend snugly around a woman's back while the bra is being worn by the woman; and a back panel extending along the rear neckline area of the body portion of the shirt, and further extending downwards from the rear neckline area to the rear elastic strap of the bra, the back panel being configured to loosely couple the rear elastic strap to the back portion of the body portion of the shirt, the back panel being made, at least in part, of fabric, wherein the back panel is configured to form, at an end thereof adjacent the rear elastic strap of the bra, a fabric tube through which the rear elastic strap passes as it extends snugly around the woman's back, the rear elastic strap being further configured to slide back and forth through the fabric tube to allow torsional rotation of the woman's upper body while imposing reduced movement to the shirt.

13. The garment and bra combination of claim 12 wherein the back panel has a coupling to the rear neckline area of the body portion of the shirt, the coupling extending between left and right shoulder locations where the sleeve portions attach to the body portion of the shirt.

14. The garment and bra combination of claim 13 wherein the back panel has a width that is substantially equivalent to the distance the coupling extends between left and right shoulder locations.

15. A garment and bra combination, comprising:

a shirt having a body portion, the body portion having an upper back area and defining a body cavity of the shirt;

a bra operable to be worn to provide breast support to a woman's breasts, the bra including left and right breast cups and a rear strap operable to extend around a back of the woman's torso, the bra further including front breast cup straps that extend, respectively, from the top of each breast cup to an upper shoulder area of the shirt, the breast cup straps providing front breast support to a respective breast cup to which they attach, the bra further including a back panel coupling the rear strap to the upper back area of the body portion of the shirt, wherein the back panel is configured to form, at an end thereof adjacent the rear strap of the bra, a fabric tube through which the rear strap passes as it extends snugly around the woman's back, the rear strap being configured to slide back and forth through the fabric tube to allow side-to-side rotational movement of the woman's torso without substantially translating the movement to the shirt.

* * * * *